United States Patent [19]

Womack, Jr. et al.

[11] Patent Number: 4,934,569

[45] Date of Patent: Jun. 19, 1990

[54] PRESSURIZED FLUID INJECTION METHOD AND MEANS

[75] Inventors: Joseph F. Womack, Jr., Ogden; Rodney L. Griffin, Roy, both of Utah

[73] Assignee: Westinghouse Electric Corp., Pittsburgh, Pa.

[21] Appl. No.: 286,400

[22] Filed: Dec. 19, 1988

[51] Int. Cl.[5] ..... B67D 3/00

[52] U.S. Cl. ..... 222/195; 366/101; 366/106; 366/107; 406/85; 406/88; 406/137

[58] Field of Search ..... 222/195, 3, 4, 491, 222/494; 209/295, 321, 245; 366/107, 106, 101; 406/85, 86, 88, 137; 239/68, 142, 143, 533.13

[56] References Cited

U.S. PATENT DOCUMENTS

| | | | |
|---|---|---|---|
| 1,589,400 | 6/1926 | Klinglesmith . | |
| 1,995,551 | 3/1935 | Shodron . | |
| 2,255,438 | 9/1941 | Robinson | 239/533.13 X |
| 2,753,001 | 7/1956 | Page | 239/533.13 X |
| 2,771,320 | 11/1956 | Korwin | 239/533.13 X |
| 3,010,620 | 11/1961 | Folse | 222/564 |
| 3,035,739 | 5/1962 | Berg | 222/135 |
| 3,677,936 | 7/1972 | Bastiaanse | 239/533.13 X |
| 3,713,564 | 1/1973 | Cottrell | 222/195 X |
| 3,926,814 | 12/1975 | Hogarth | 210/323 |
| 3,933,280 | 1/1976 | Plumb | 222/195 X |

FOREIGN PATENT DOCUMENTS

| | | | |
|---|---|---|---|
| 2174372 | 11/1986 | United Kingdom | 222/195 |

OTHER PUBLICATIONS

CCC Model AD Aerator trade literature.

*Primary Examiner*—Kevin P. Shaver
*Assistant Examiner*—David H. Bollinger
*Attorney, Agent, or Firm*—R. A. Stoltz

[57] ABSTRACT

A pressurized fluid is injected into a mass of material through at least one length of hose or other tubing of inherently resilient, elastomer material having one end closed and provided with at least one series of potential openings cut into the elastomer material along the length of the tubing so as to be normally tightly closed by reason of the resiliency of the elastomer material but stretched open under the influneces of the pressurized fluid, which is introduced through the opposite end of the length of tubing. Gravity discharge of particulate material from a vessel having a hopper portion at its bottom can be effectively activated in this manner by the fluid-injection device of the invention.

12 Claims, 1 Drawing Sheet

PRESSURIZED FLUID INJECTION METHOD AND MEANS

BACKGROUND OF THE INVENTION

1. Field of the Invention:

The invention is primarily concerned with flow activation of particulate solids in bins, silos, and other vessels having gravity discharge hoppers, but also pertains broadly to the injection of a pressurized fluid into material with a vessel or otherwise.

2. Description of the Prior Art:

Gravity discharge of various particulate solids from the hoppers of storage vessels, such as bins, silos, and the like, is often held up by bridging of the material in the hopper above the discharge openings, especially when the particulate solids are of very fine size as a powder. Various mechanical structures positioned within such hoppers have been developed for the purpose of preventing bridging. These are not always effective. Porous activating pads for introducing a fluid under pressure into the material in the hopper are sometimes used, but have not been entirely satisfactory largely because of the tendency of particulate solids in the hopper to plug the discharge orifices during times that the pads are inactive.

SUMMARY OF THE INVENTION

In accordance with the present invention, at least one length of hose or other tubing made of an elastomer material, such as rubber, and having one end closed, is provided with a series of potential openings along its length for being stretched open under the pressure of a pressurized fluid introduced into such length at the opposite end from a suitable source, so as to inject such fluid into the particulate material sought to be discharged through the hopper or into any material into which it is desired to inject a fluid. A suitable valve, operated either manually or automatically, controls flow of the pressurized fluid into the length of tubing, and the inherent resiliency, i.e., elasticity, of the material from which the tubing is made ensures tight closing of the openings when supply of the pressurized fluid is halted. This has been found to be a very effective way of activating flow of material from a hopper after hang-up, or of preventing hang-up in the first place. Because only potential openings, that are normally maintained tightly closed by reason of the inherent elasticity of the material from which the length of tubing is made, are provided for passage of the pressurized fluid into the surrounding particulate solids in a hopper, there can be no plugging by the solids in the hopper awaiting discharge.

BRIEF DESCRIPTION OF THE DRAWING

The best mode presently contemplated for carrying out the invention in actual practice is shown in the accompanying drawing, in which.

DETAILED DESCRIPTION OF THE ILLUSTRATED EMBODIMENTS

Figure 2:
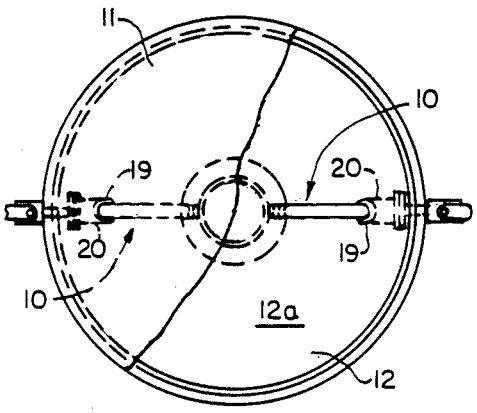
FIG. 2, a top plan view, with part of the bin cover broken away to reveal the interior of the bin from which the particulate material has been removed so as to show the flow-activating devices of the invention.
Figure 1:
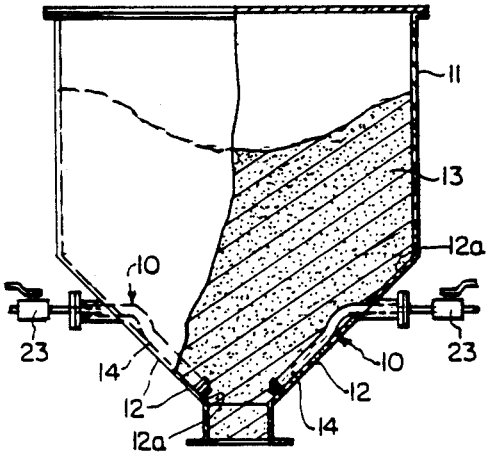
FIG. 1 is a view in side elevation, shown partly in axial vertical section, of a typical storage bin containing particulate material for discharge through the gravity discharge hopper bottom portion of the bin, which is provided with flow-activating devices of the invention.

In the combination of the device 10 of the invention with a typical bin 11 having a conical, gravity discharge hopper bottom portion 12, as shown in FIGS. 1 and 2, only two of the devices 10 are provided for flow activation of the particulate material 13 within such bin, the two being placed diametrically across from each other about the axis of the bin and sloping divergently upwardly along inner surfaces 12*a* of the walls of such hopper bottom portion 12 of the bin.

Each of the flow-activation devices 10 comprises a length 14 of tubing of elastomer material having inherent resiliency, such as a rubber hose, with one end closed as by a plug 15 held in place by a stainless steel band and screw clamp 16. Length 14 is provided with one or more, preferably several, series 17 of potential openings 18, which are normally tightly closed by reason of the inherent resiliency of the elastomer material of the tubing.

In the illustrated instance, the potential openings 18 are elongate cuts made through the elastomer material, and each series 17 extends longitudinally of the length 14 of tubing. It has been found that the length of each elongate cut providing a potential opening 18 should not be greater than approximately twice the wall thickness of the elastomer tubing for best performance.

Figure 5:
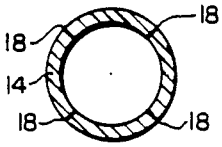
FIG. 5, a transverse section through a device of the invention as taken on the line 5—5 of FIG. 4 to show the tightly closed cuts constituting the potential openings.
Figure 6:
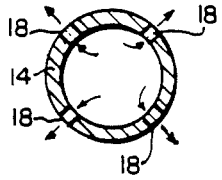
FIG. 6, a view corresponding to that of FIG. 5 but taken when pressure fluid within the tubing has stretched the resilient walls of the tubing to open the cuts for outward flow of the pressurized fluid.
Figure 4:
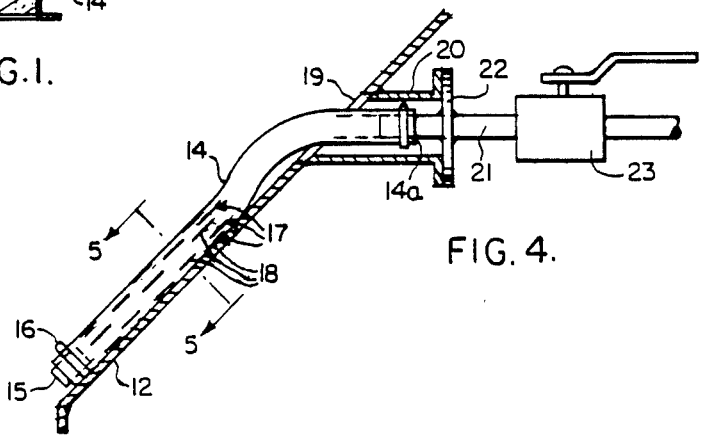
FIG. 4, an enlarged portion of the part of the hopper that is shown in vertical section in FIG. 1, with the device of the invention similarly enlarged.

The potential openings are provided in the elastomer material of the tubing by puncturing or otherwise cutting such material with a sharp implement and without removal of material, see FIG. 5, so that they remain tightly closed until the elastomer material is stretched by pressure fluid within the length of tubing, see FIG. 6. They may be of any shape, from a simple point puncture to an elongate cut whether rectilinear, curved, or otherwise, so long as they tightly close by reason of the inherent resiliency of the elastomer material in unstretched condition. This prevents particulate matter from entering and plugging the fluid-flow channels when the lengths of tubing are unpressurized and lying relaxed in the bin or other gravity-discharge vessel during such times of discharge of material from the vessel is not desired, as is often the case with storage bins or the like.

The opposite end of the length of tubing, here 14*a*, is open for flow communication with a source of a pressurized fluid, such as air. In the illustrated instance, the hopper bottom portion 12 of bin 11 is provided laterally with mutually opposite openings 19 from which extend, exteriorly of such hopper, respective fittings 20 providing passage for respective pressurized fluid supply pipes 21 that extend through closure plates 22, respectively, of such fittings 20. Over the ends of such supply pipes 21 within fittings 20 the open ends 14*a* of the respective tubing lengths 14 are closely fitted and tightly clamped. Manually operated valves 23 control flow of fluid into the respective tubing lengths 14. Such valves could be automatically controlled in suitable instances.

As many tubing lengths are found appropriate can be used in individual instances, and placement within the bins, hoppers, or other vessels may be as found necessary or desirable in specific instances. The tubing lengths can be interconnected in networks and can be arranged relative to the walls of the vessel or along intersections of such walls as found suitable under various conditions of use.

Figure 3:
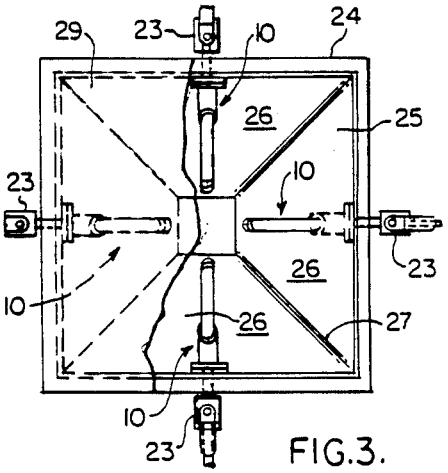
FIG. 3, is a view similar to that of FIG. 2, but showing a differently shaped hopper with additional devices of the invention in place.

As shown in FIG. 3, the bin 24 and its hopper bottom portion 25 may be rectangular in horizontal cross-section, with gravity discharge flow at the corners being activated or assisted by devices 10 of the invention placed either midway of the several internal wall surfaces 26, as shown, or at and along the corners 27. In either instance, the several devices 10 extend about the axis of the gravity discharge opening 28.

The tubing lengths may enter the material-containing vessel as shown, or any other way, such as through the top cover 29 or through the top opening of an uncovered vessel. Moreover, the tubing lengths with their potential openings may extend throughout the entire, or along part of, the height of the vessel or throughout the entire, or along part of, the height of the hopper discharge bottom portion only.

In some instances, gravity flow of particulate material from one part of a non-discharging storage or processing vessel to another part thereof may be activated, or a processing fluid may be introduced into a mass of particulate solids or other material in a vessel or otherwise by use of one or more devices of the invention.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim as our invention:

1. In combination with a gravity discharge hopper having walls with surfaces inside the hopper confronting the interior of the hopper; at least one length of tubing of elastomer material, having inherent resiliency, positioned adjacent to the inside surface of a wall of said hopper; means closing one end of said length of tubing; a series of potential openings in said length of tubing confronting the interior of said hopper, said openings being normally tightly closed by reason of the inherent resiliency of said elastomer material; and means whereby a fluid under pressure may be introduced into said length of tubing for expanding said elastomer material and thereby opening said potential openings to cause said fluid to flow into the hopper.

2. A combination according to claim 1, wherein the potential openings are cuts made in the resilient material of the tubing without removing any of said material.

3. A combination according to claim 2, wherein the cuts are slits extending longitudinally of the length of said tubing.

4. A combination according to claim 3, wherein each slit has a maximum length approximately twice the wall thickness of the elastomer tubing.

5. A combination according to claim 1, wherein the discharge hopper is substantially rectangular in cross section taken horizontally through the hopper.

6. A combination according to claim 1, wherein the means whereby a fluid under pressure may be introduced into the length of tubing comprises a valve-controlled supply pipe in fluid flow communication with the end of said length of tubing that is opposite the closed end of said length of tubing.

7. A combination according to claim 1, wherein several similar lengths of the tubing are arranged about the discharge axis of the hopper.

8. In combination with a mass of material made up of particulate solids and contained in a vessel having a gravity discharge hopper at its bottom, at least one length of elastomer tubing having inherent resiliency and positioned within said mass so as to be covered by the material thereof; means closing one end of said length of tubing; a series of potential openings in said length of tubing placed to confront said material, said openings being normally tightly closed by reason of the inherent resiliency of said elastomer tubing; and means whereby a fluid under pressure may be introduced into said length of elastomer tubing for expanding it to thereby open said potential openings allowing said fluid to flow into said mass of material so as to cause said mass to flow into the gravity discharge hopper of said vessel.

9. A combination according to claim 8, wherein the potential openings are cuts made in the resilient material of the tubing.

10. A combination according to claim 9, wherein the cuts are slits extending longitudinally of the length of said tubing.

11. A combination according to claim 10, wherein each slit has a maximum length approximately twice the wall thickness of the elastomer tubing.

12. A method of introducing a fluid into a mass of material made up of particulate solids in a vessel having a gravity discharge opening at its bottom, comprising injecting a pressurized fluid into said material through one or more devices comprising a length of tubing of elastomer material having inherent resiliency; means closing one end of said length of tubing, the opposite end being open for flow communication with a source of pressurized fluid; and a series of potential openings in and along said length of tubing that are normally tightly closed by reason of the resiliency of said elastomer material and that open by reason of the resiliency of said elastomer material when expanded under the pressure of said pressurized fluid within the tubing to effect flow of said fluid from tubing for the purpose of activating flow of the particulate solids through the discharge opening of said vessel.

* * * * *